United States Patent [19]

Karlberger

[11] 4,084,421

[45] Apr. 18, 1978

[54] APPARATUS FOR TWISTING AND GUIDING STOCK INTO ROLL GROOVES

[75] Inventor: Walter Johann Karlberger, Smedjebacken, Sweden

[73] Assignee: Morgardshammar Aktiebolag, Smedjebacken, Sweden

[21] Appl. No.: 748,325

[22] Filed: Dec. 7, 1976

[30] Foreign Application Priority Data

Dec. 10, 1975 Sweden ..... 7513933

[51] Int. Cl.[2] ..... B21B 39/28

[52] U.S. Cl. ..... 72/231; 72/251

[58] Field of Search ..... 72/250, 251, 227, 231, 72/428

[56] References Cited

U.S. PATENT DOCUMENTS

| | | | |
|---|---|---|---|
| 1,405,985 | 2/1922 | Ekstrand | 72/231 |
| 3,699,795 | 10/1972 | Pilling | 72/250 X |

*Primary Examiner*—Milton S. Mehr

*Attorney, Agent, or Firm*—Young & Thompson

[57] ABSTRACT

Apparatus for twisting and guiding metal stock into roll grooves, comprises a guide mounted in front of such a groove. The guide has a through path from which the stock emerges from the guide and passes to the groove, and a feed path disposed to one side of the through path. The feed path is defined by a funnel-shaped member having an opening therethrough of about the same size and shape as the stock to be fed, and which is mounted for swinging movement between two positions, in one of which it is out of line with the through path and in the other of which it is in line with the through path. The stock is fed through the swinging member in the out-of-line position and contacts a cam surface which moves the stock and hence the swinging member, into line with the through path, thereby twisting the stock about 90°. After the stock is passed, the swinging member returns by gravity to its out-of-line position.

2 Claims, 4 Drawing Figures

APPARATUS FOR TWISTING AND GUIDING STOCK INTO ROLL GROOVES

Figure 1:
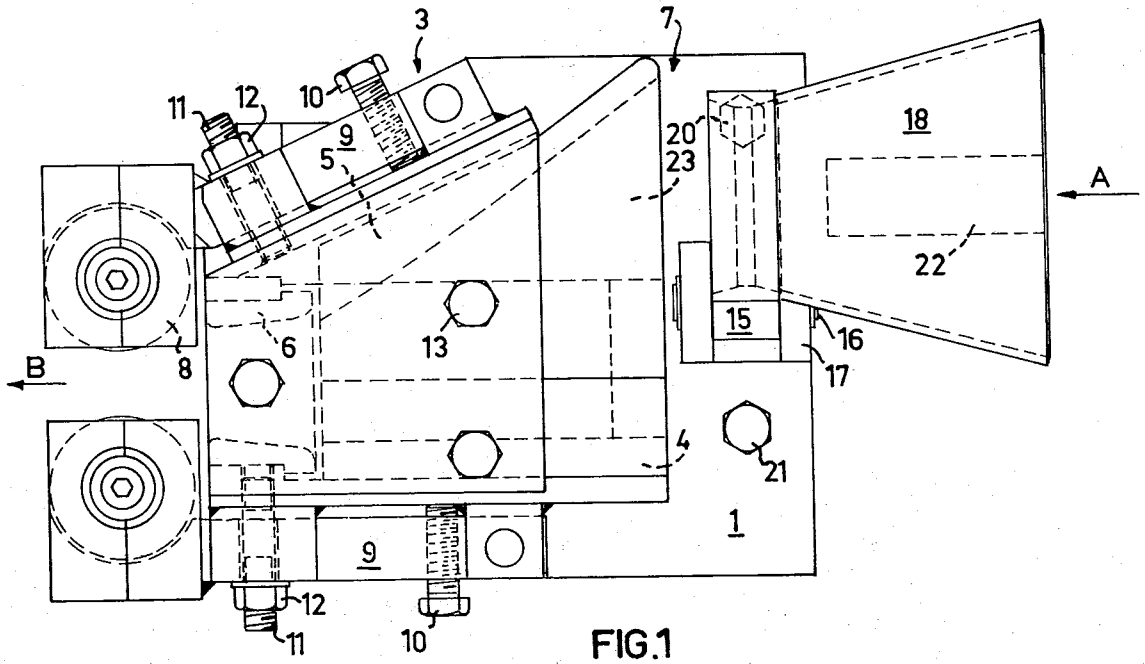

Different types of equipment are known for ensuring correct guidance of hot stock into the roll grooves in hot rolling mills. Furthermore, different kinds of apparatus for turning or twisting the stock 90° about its longitudinal axis are known, for example so-called manipulators, which even shift the stock sideways from one groove to another. Among these are tilting tables and fixed roller tables, both these types being provided or coacting with grooved rollers, and cast channels with tilting flanges, which twist the stock and move it to the grooved rolls. Also known are tiltable channels and stock tilters in the shape of tiltable cradles. In spite of these apparatuses bringing with them the advantages of quick rolling and capacities which are variable within wide limits, furthermore reducing personnel requirements, they have however the important common disadvantages that they all require separate and comparatively complicated driving means and they require much space.

The object of the present invention is to remove the drawbacks of these known apparatuses while retaining their advantages, by providing improved apparatus for twisting and guiding stock into roll grooves.

It is previously known in guiding stock into roll grooves to provide guidance of the individual stock with the aid of a guiding means mounted in front of said grooves, having a substantially funnel-shaped passage corresponding suitably to the cross-sectional shape and size of the stock; and at the exit end of said passage the stock possibly while engaging with at least two of its sides against further guiding means, e.g. in the form of rotatable wheels or rollers, is led into the roll groove. It is proposed according to the invention that the stock be fed along a path situated to one side of the through-path through the guiding means and be caused to pass through a movable means provided with an opening or orifice at least substantially corresponding to the cross-section of the stock, which then meets with its forward end a guiding surface bridging the distance between the feed path and through-path. The stock is caused by this surface to move in a direction towards the through-path and as a result thereof forces the movable means into a corresponding movement which, under the intermediary of the movable means, causes twisting of the stock, which thereafter in its twisted position is steered in a manner known per se into the roll groove by the guiding means and possible further guiding means. The significance of the feed path of the stock being situated to one side of the through-path through the guiding means and the possible further guiding means is that both paths are displaced in relation to each other to an extent and direction required for achieving the desired twisting of the stock. Since the cross-sectional shape and dimensions of the stock determine the size of the movement of the movable means providing the twisting of the stock, the distance between both paths and the direction of the displacement between them will also be quite generally dependent thereon.

In practical trails it has been found that, when applying the method according to the invention, separate driving means and voluminous auxiliaries for providing stock twisting can be completely dispensed with, which takes place according to the invention only with the assistance of the feeding movement of the individual stock itself.

In addition to these advantages, the invention also has the further advantage that twisting or tilting of the stock can take place in the immediate vicinity of the guiding means, which by reason thereof, and simply, can be given such a design that they coact in twisting the stock.

An apparatus which has been found especially suitable for carrying out the method in the said practical trials is one starting out from known technique and comprising at least one guiding means mounted in front of the roll groove, having a substantially funnel-shaped passage suitably corresponding to the cross-sectional shape and size of the stock, which is steered into the roll grooves at the exit end of the passage, possibly while engaging with at least two of its sides against further guiding means, e.g. rotatable wheels or rollers. What is novel in this apparatus, and what is essentially characterizational according to the invention is that a means comprising an opening or orifice at least substantially corresponding to the cross-section of the stock, is arranged in front of the guiding means, seen from the chief direction of the stock through the apparatus in a feed path intended for the stock and arranged at one side of the through-path of the guiding apparatus being movable with its opening or orifice between these both paths, there being a guiding surface for the forward end of the stock arranged after the movable means for bridging over the distance between the paths. It will be seen herefrom that an apparatus according to the invention will be extremely simple and operationally reliable since it requires only two vital parts, namely a) a means in front of the known guiding means, which firstmentioned means is movable with an opening or orifice adapted to the cross-sectional shape of the stock between the through-path of the known guiding means and the feed path for the stock to one side thereof, and b) a guiding surface situated after this movable means for bridging over the distance between both said paths. It is the stock itself which, as a result of its forward end meeting the guiding surface and being caused by it to move in a direction towards the through-path of the known guiding means, forces the movable means into the movement causing the stock to twist. This twisting takes place simultaneously with the stock being transferred by the guiding surface from its feed path to the through-path of the known guiding means in front of the roll grooves. Therefore no other driving means are required for providing the working movement of the movable means either.

The means with its opening or orifice movable between the feed path of the stock and the through-path of the guiding means can be made in a plurality of different ways within the scope of the invention. In one embodiment which has been found to be advantageously simple from the point of view of manufacture and practical reliability, it has for example taken the form of an element pivotable between two positions. Since the mounting point for such a pivotable element can be placed in relation to its center of gravity so that it automatically returns to one of its two positions as a result of its own weight, the advantage is also obtained that no separate driving means are required for returning the movable means after completed stock twisting movement either.

To facilitate guiding into the opening or orifice in the movable means or pivotable element of the stock approaching along its feed path, the means can be provided with a funnel-shaped catching device on the side facing towards the feed path.

Similarly to the movable means, the guiding surface arranged after it for the forward end of the approaching stock can be made in a plurality of different ways within the scope of the invention. It has, however, been found especially advantageous to design this surface as a portion of the substantially funnel-shaped passage of the known guiding means.

The invention will now be described while referring to an embodiment shown on the appended drawings.

Figure 2:
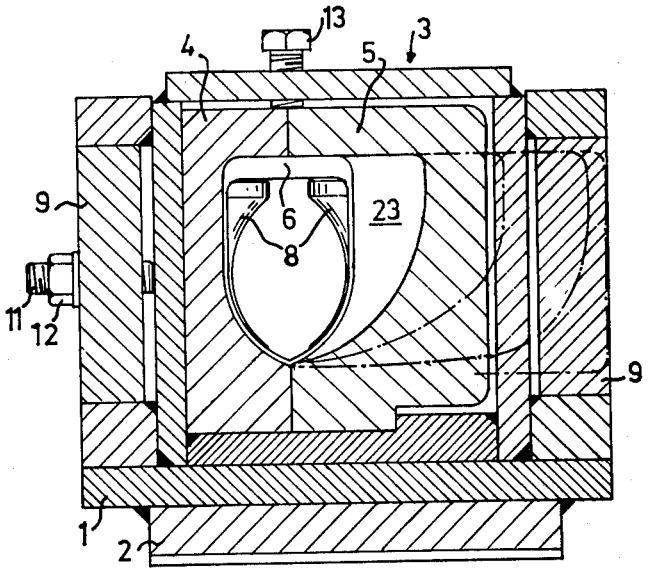
Figure 4:
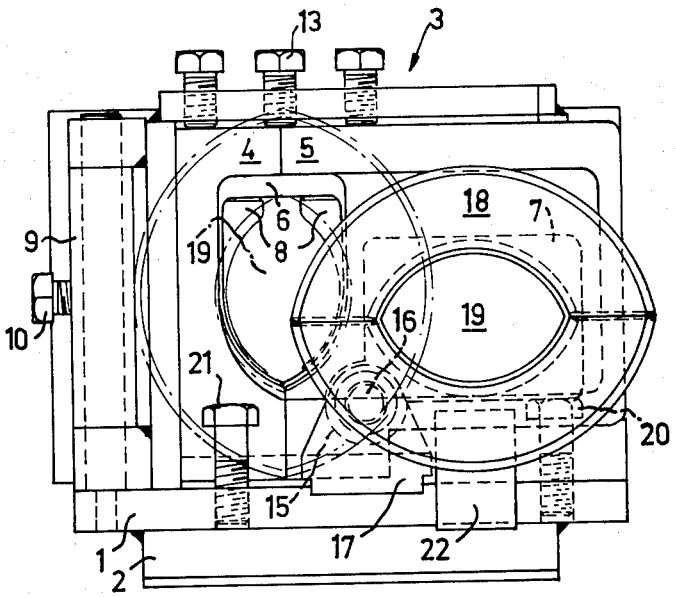
Figure 3:
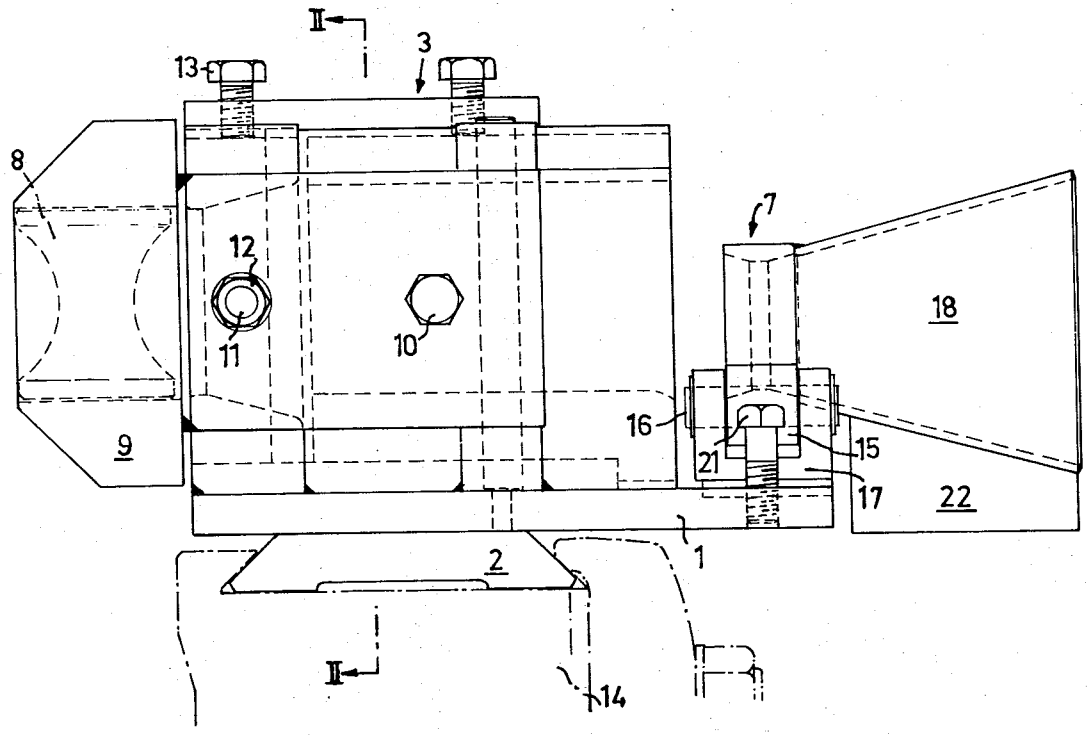

FIG. 1 shows a total view seen from above of an especially advantageous embodiment of an apparatus according to the invention for twisting and guiding stock into roll grooves, FIG. 2 is a section along the line II—II in FIG. 3 of this apparatus, showing the guiding surface vital for realizing the invention incorporated, FIG. 3 is a total view of the apparatus, seen from one side, and FIG. 4 finally shows an end view seen from the right in FIG. 3 showing in both its end positions the movable means incorporated in the apparatus and vital for realizing the invention.

The embodiment of the apparatus according to the invention shown on the drawings is intended to twist or tilt stock by 90° and thereafter guide it into and retain it in a roll groove.

As is apparent from the drawings, the apparatus consists principally of a bottom plate 1 provided on its underside with a foot 2. On its upper side this bottom plate carries a housing 3 open on either side. Inside this housing there are mounted three inserts 4, 5, 6 in the shown embodiment, the inserts together forming an at least substantially funnel-shaped passage through the housing 3, inside which the inserts are clamped by means of bolts 13. In front of the larger or inlet opening to this passage there is a movable means in the form of an element 7 mounted on the plate 1 and pivotable between two end positions. Outside the smaller opening or exit opening from the passage there are guiding means on either side, in the shape of two rotatable rollers 8, each journalled in a holder 9 which is mounted on one side of the housing 3 both swingably and fixably in relation to it by means of set screws 10, pretensioned compression springs (not shown) and locking means 11, 12 known per se.

By means of the foot 2, the shown apparatus is intended to be attached to a rest bar 14 in a rolling mill with the outlet opening surrounded by the rotatable rollers 8 being carefully directed towards a pair of roll grooves so that a correctly-turned stock coming out of the apparatus will be carefully led into said pair of roll grooves, two sides of said stock abutting the rollers 8.

Of the three inserts 4, 5, 6 clamped in the housing 3, together forming the at least substantially funnel-shaped passage through the housing, the one denoted 6 has the exit opening with a shape suitably adapted to the intended stock, while both remaining inserts 4, 5 have the shape of a pair of halves together forming the wide inlet opening and the greater portion of the passage length.

The movable means or pivotable element 7 has, in the embodiment shown, a generally rectangular shape and is, as is apparent from the drawings, provided at one lower corner with a mounting lug 15, by which the element is pivotably mounted by means of a through-shaft 16 on a fork-like detail 17, in its turn attached to the bottom plate 1. On its side facing away from the inlet opening to the substantially funnel-shaped passage through the housing 3, the pivotable element 7 is provided with a funnel-like catching means 18 facing towards the feed path of the stock approaching the apparatus, the catching means being so formed as to guide the forward end of the approaching stock into an opening or orifice 19 in the element 7 at least substantially corresponding to the cross-section of the stock. The end positions for the movement of the movable means or pivotable element 7 can for example be determined by both the screws 20, 21 screwable into the bottom plate 1, the one denoted 20 determining the position of the means or element 7 while awaiting stock and the other denoted 21 determining the position at which stock is turned through 90° and guided into the substantially funnel-shaped path through the housing or guiding means 3.

As is also apparent from the drawing the movable means or pivotable element 7, according to the invention, is situated with its opening or orifice 19 between the feed path of the stock and the substantially funnel-shaped path or through-path of the housing or guiding means 3, both said paths being displaced sideways in relation to each other. This is apparent from the arrows in FIG. 1, of which one is marked A and shows the arrival or feed path of the stock, and the other is marked B and shows the path of the stock through the housing or guiding means 3.

Because the mounting point 15, 16 of the pivotable element or movable means 7 is disposed at one bottom corner thereof, and as will be easily seen from the drawings, the center of gravity of the element will always be to one side of the mounting point and as a result of the built-on counterweight 22, the element will return by its own weight to one of its two positions, i.e. its waiting position (shown on the drawings in full lines).

Apart from the movable means 7 a guiding surface for the forward end of the stock is however required to realize the invention, said guiding surface bridging the distance between the feed path A of the stock and the through-path B through the housing or guiding means 3. In the embodiment shown here, this guiding surface consists of a portion 23 of the substantially funnel-like passage of the housing or guiding means 3. In actual fact, this guiding surface or this portion 23 is formed on the inside of the insert 5 as a double-curved concave surface which forces stock, introduced through the opening 19 of the movable means or pivotable element 7, into the passage in the housing or guiding means 3 on the wider side of its forward end to transfer from feed path A to through-path B of the housing or guiding means 3, whereby the movable means or pivotable element 7 is forced into a movement by the movement of the stock itself from the position shown by full lines in FIG. 4 to the position shown by chain lines in the same figure, during which movement the means or element 7 has turned the stock 90°, i.e. it has placed the stock which was lying on its side in the beginning on edge before introduction into the roll groove.

When the terminating end of the stock has passed through the opening or orifice 19 in the movable means or pivotable element 7, the latter falls back into the waiting position as a result of its own weight, i.e. into the position shown with full lines in FIG. 4.

In the embodiment shown here the cross-section of the stock is intended to be oval. This is however no pre-condition for an apparatus according to the invention. Other cross-sections for the stock, e.g. preforms for hexagonal bars, flats etc. can also be used. All that is required is that the opening 19 in the movable means or the pivotable element 7 and the substantially funnel-like passage through the guiding means or housing 3 with associated guiding surface 23 are formed thereafter.

The invention is not limited to the embodiment shown on the drawings and described here, but can be modified in a plurality of ways within the scope of the claims.

What I claim is:

1. Apparatus for twisting and guiding stock into a roll groove, comprising guide means adapted to be mounted in front of a said groove, said guide means comprising a funnel having a noncircular crosssectional shape of about the same size and shape as the stock to be fed, for receiving the end of stock passing toward the groove, said guide means having means defining a through path for said stock, means mounting said funnel for swinging movement about an axis parallel to said through path, between a first position in which said funnel is out of line with said through path and a second position in which said funnel is in line with said through path, and cam means disposed between said funnel and said means defining said through path for receiving the leading end of said stock emerging from said funnel when said funnel is in said first position and diverting said leading end into line with said through path, whereby said stock deflected by said cam causes said funnel to swing about said axis from said first position to said second position thereby to twist said leading end of said stock.

2. Apparatus as claimed in claim 1, the center of gravity of said funnel being so located relative to said axis that in the absence of said stock, said funnel swings by gravity from said second position to said first position.

* * * * *